US009881569B2

(12) United States Patent
Tada et al.

(10) Patent No.: US 9,881,569 B2
(45) Date of Patent: Jan. 30, 2018

(54) IMAGE DISPLAY APPARATUS AND CONTROL METHOD THEREOF

(71) Applicant: CANON KABUSHIKI KAISHA, Tokyo (JP)

(72) Inventors: Mitsuru Tada, Machida (JP); Yoshiyuki Nagashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/064,278

(22) Filed: Mar. 8, 2016

(65) Prior Publication Data

US 2016/0267850 A1 Sep. 15, 2016

(30) Foreign Application Priority Data

Mar. 10, 2015 (JP) ..... 2015-047279

(51) Int. Cl.
*G09G 3/36* (2006.01)
*G09G 3/34* (2006.01)

(52) U.S. Cl.
CPC ..... *G09G 3/3607* (2013.01); *G09G 3/3426* (2013.01); *G09G 2320/066* (2013.01); *G09G 2320/0626* (2013.01); *G09G 2320/0666* (2013.01); *G09G 2360/16* (2013.01)

(58) Field of Classification Search
CPC ..... G09G 2320/0626; G09G 2320/066
USPC ..... 345/76, 77, 102
See application file for complete search history.

(56) References Cited

U.S. PATENT DOCUMENTS 6,987,521 B2 * 1/2006 Mori ..... G09G 3/22 345/214
2010/0118062 A1 * 5/2010 Mori ..... G09G 3/3225 345/690
2011/0205442 A1 * 8/2011 Mori ..... G09G 3/3208 348/673
2015/0194091 A1 * 7/2015 Tusch ..... G09G 3/3291 345/690
2015/0279284 A1 * 10/2015 Yano ..... G09G 3/3208 345/690

FOREIGN PATENT DOCUMENTS

JP 2007-012534 A 1/2007

* cited by examiner

*Primary Examiner* — Roy Rabindranath
(74) *Attorney, Agent, or Firm* — Cowan, Liebowitz & Latman, P.C.

(57) ABSTRACT

An image display apparatus according to the present invention includes a light-emitting unit, a display unit configured to display an image on a screen by modulating light from the light-emitting unit based on image data, a first acquiring unit configured to acquire brightness information on brightness of the image data, an image-processing unit configured to perform image processing on input image data, a second acquiring unit configured to acquire processing information on the image processing, and a control unit configured to control emission brightness of the light-emitting unit based on the brightness information and the processing information, so as to suppress a change in contrast of an image, which is displayed on the screen, caused by the image processing.

26 Claims, 6 Drawing Sheets

INPUT IMAGE DATA
PROCESSING INFORMATION
101
LIQUID CRYSTAL PANEL
102
BACKLIGHT
103
IMAGE-PROCESSING UNIT
104
BRIGHTNESS INFORMATION ACQUIRING UNIT
105
PROCESSING INFORMATION ACQUIRING UNIT
106
CONTROL UNIT
107
BL CONTROL VALUE DETERMINING UNIT
108
CHANGE INFORMATION ACQUIRING UNIT
109
BL CONTROL VALUE CORRECTING UNIT

FIG. 3A

| | TARGET TEMPERATURE | IMAGE COLOR | PIXEL VALUE [%] | | BL BRIGHTNESS [%] | DISPLAY BRIGHTNESS [%] |
|---|---|---|---|---|---|---|
| COMPARATIVE EXAMPLE | D65 | WHITE | R VALUE | 100 | 100 | 100 |
| | | | G VALUE | 100 | | |
| | | | B VALUE | 100 | | |
| | | BLACK | R VALUE | 0 | | 0.1 |
| | | | G VALUE | 0 | | |
| | | | B VALUE | 0 | | |
| COMPARATIVE EXAMPLE | D50 | WHITE | R VALUE | 100 | 110 | 100 |
| | | | G VALUE | 90 | | |
| | | | B VALUE | 66 | | |
| | | BLACK | R VALUE | 0 | | 0.11 |
| | | | G VALUE | 0 | | |
| | | | B VALUE | 0 | | |

FIG. 3B

| | TARGET TEMPERATURE | CONTRAST |
|---|---|---|
| COMPARATIVE EXAMPLE | D65 | 1000 |
| | D50 | 900 |

FIG. 4A

| | TARGET TEMPERATURE | IMAGE COLOR | PIXEL VALUE [%] | | BL BRIGHTNESS [%] | DISPLAY BRIGHTNESS [%] |
|---|---|---|---|---|---|---|
| EXAMPLE 1, 2 AND MODIFICATION | D65 | WHITE | R VALUE | 100 | 100 | 100 |
| | | | G VALUE | 100 | | |
| | | | B VALUE | 100 | | |
| | | BLACK | R VALUE | 0 | | 0.1 |
| | | | G VALUE | 0 | | |
| | | | B VALUE | 0 | | |
| EXAMPLE 1 | D50 | WHITE | R VALUE | 100 | 100 | 90 |
| | | | G VALUE | 90 | | |
| | | | B VALUE | 66 | | |
| | | BLACK | R VALUE | 0 | 90 | 0.09 |
| | | | G VALUE | 0 | | |
| | | | B VALUE | 0 | | |
| MODIFICATION | D50 | WHITE | R VALUE | 100 | 110 | 100 |
| | | | G VALUE | 90 | | |
| | | | B VALUE | 66 | | |
| | | BLACK | R VALUE | 0 | 100 | 0.1 |
| | | | G VALUE | 0 | | |
| | | | B VALUE | 0 | | |
| EXAMPLE 2 | D50 | WHITE | R VALUE | 100 | 105 | 95 |
| | | | G VALUE | 90 | | |
| | | | B VALUE | 66 | | |
| | | BLACK | R VALUE | 0 | 95 | 0.095 |
| | | | G VALUE | 0 | | |
| | | | B VALUE | 0 | | |

FIG. 4B

| | TARGET TEMPERATURE | CONTRAST |
|---|---|---|
| EXAMPLE 1, 2 AND MODIFICATION | D65 | 1000 |
| | D50 | 1000 |

FIG. 5A

| | TARGET TEMPERATURE | IMAGE COLOR | PIXEL VALUE [%] | | BL BRIGHTNESS [%] | DISPLAY BRIGHTNESS [%] |
|---|---|---|---|---|---|---|
| COMPARATIVE EXAMPLE | D65 | WHITE | R VALUE | 100 | 100 | 100 |
| | | | G VALUE | 100 | | |
| | | | B VALUE | 100 | | |
| | | BLACK | R VALUE | 0 | 50 | 0.05 |
| | | | G VALUE | 0 | | |
| | | | B VALUE | 0 | | |
| COMPARATIVE EXAMPLE | D50 | WHITE | R VALUE | 100 | 110 | 100 |
| | | | G VALUE | 90 | | |
| | | | B VALUE | 66 | | |
| | | BLACK | R VALUE | 0 | 55 | 0.055 |
| | | | G VALUE | 0 | | |
| | | | B VALUE | 0 | | |

FIG. 5B

| | TARGET TEMPERATURE | CONTRAST |
|---|---|---|
| COMPARATIVE EXAMPLE | D65 | 2000 |
| | D50 | 1818 |

FIG. 6A

| | TARGET TEMPERATURE | IMAGE COLOR | PIXEL VALUE [%] | | BL BRIGHTNESS [%] | DISPLAY BRIGHTNESS [%] |
|---|---|---|---|---|---|---|
| EXAMPLE 1, 2 AND MODIFICATION | D65 | WHITE | R VALUE | 100 | 100 | 100 |
| | | | G VALUE | 100 | | |
| | | | B VALUE | 100 | | |
| | | BLACK | R VALUE | 0 | 50 | 0.05 |
| | | | G VALUE | 0 | | |
| | | | B VALUE | 0 | | |
| EXAMPLE 1 | D50 | WHITE | R VALUE | 100 | 100 | 90 |
| | | | G VALUE | 90 | | |
| | | | B VALUE | 66 | | |
| | | BLACK | R VALUE | 0 | 45 | 0.045 |
| | | | G VALUE | 0 | | |
| | | | B VALUE | 0 | | |
| MODIFICATION | D50 | WHITE | R VALUE | 100 | 110 | 100 |
| | | | G VALUE | 90 | | |
| | | | B VALUE | 66 | | |
| | | BLACK | R VALUE | 0 | 50 | 0.05 |
| | | | G VALUE | 0 | | |
| | | | B VALUE | 0 | | |
| EXAMPLE 2 | D50 | WHITE | R VALUE | 100 | 105 | 95 |
| | | | G VALUE | 90 | | |
| | | | B VALUE | 66 | | |
| | | BLACK | R VALUE | 0 | 47.5 | 0.0475 |
| | | | G VALUE | 0 | | |
| | | | B VALUE | 0 | | |

FIG. 6B

| | TARGET TEMPERATURE | CONTRAST |
|---|---|---|
| EXAMPLE 1, 2 AND MODIFICATION | D65 | 2000 |
| | D50 | 2000 |

IMAGE DISPLAY APPARATUS AND CONTROL METHOD THEREOF

BACKGROUND OF THE INVENTION

Field of the Invention

The present invention relates to an image display apparatus and a control method thereof.

Description of the Related Art

A method normally used for changing a color of a display image (image displayed on a screen of an image display apparatus) is a method of changing a color of image data. If a pixel value of the image data is an RGB value (combination of an R value, a G value and a B value), the color of the pixel can be changed by changing the balance (ratio) of the R value, G value and B value. However, it is known that changing a color of image data drops the brightness of the image data and brightness of the display image.

A prior art concerning a liquid crystal display apparatus is a technique disclosed in Japanese Patent Application Laid-Open No. 2007-12534. According to the technique disclosed in Japanese Patent Application Laid-Open No. 2007-12534, if the color temperature of a display image is changed, the emission brightness of the backlight is adjusted using a correction value corresponding to the color temperature after the change, whereby the drop in brightness of the display image caused by the change of the color temperature can be suppressed.

However if a color of image data is changed, brightness of the image data drops, and as a result, the dynamic range of the image data drops. Then because of this drop in the dynamic range of the image data, contrast of the display image drops. According to the technique disclosed in Japanese Patent Application Laid-Open No. 2007-12534, the emission brightness of the backlight is adjusted using a same correction value, unless the color temperature is changed. Therefore according to the technique disclosed in Japanese Patent Application Laid-Open No. 2007-12534, the drop in contrast of the display image caused by the change of the color temperature cannot be suppressed, even if the drop in brightness of the display image caused by the change of the color temperature can be suppressed.

SUMMARY OF THE INVENTION

The present invention provides a technique to suppress the change in contrast of a display image caused by image processing.

The present invention in its first aspect provides an image display apparatus, comprising:

a light-emitting unit;

a display unit configured to display an image on a screen by modulating light from the light-emitting unit based on image data;

a first acquiring unit configured to acquire brightness information on brightness of the image data;

an image-processing unit configured to perform image processing on input image data;

a second acquiring unit configured to acquire processing information on the image processing; and a control unit configured to control emission brightness of the light-emitting unit based on the brightness information and the processing information, so as to suppress a change in contrast of an image, which is displayed on the screen, caused by the image processing.

The present invention in its second aspect provides a control method of an image display apparatus that includes a light-emitting unit, and a display unit configured to display an image on a screen by modulating light from the light-emitting unit based on image data, the control method comprising:

acquiring brightness information on brightness of the image data;

performing image processing on input image data;

acquiring processing information on the image processing; and controlling emission brightness of the light-emitting unit based on the brightness information and the processing information, so as to suppress a change in contrast of an image, which is displayed on the screen, caused by the image processing.

The present invention in its third aspect provides a non-transitory computer readable medium that stores a program, wherein the program causes a computer to execute a control method of an image display apparatus that includes a light-emitting unit, and a display unit configured to display an image on a screen by modulating light from the light-emitting unit based on image data, and the control method comprises:

acquiring brightness information on brightness of the image data;

performing image processing on input image data;

acquiring processing information on the image processing; and controlling emission brightness of the light-emitting unit based on the brightness information and the processing information, so as to suppress a change in contrast of an image, which is displayed on the screen, caused by the image processing.

According to the present invention, a change in contrast of a display image caused by image processing can be suppressed.

Further features of the present invention will become apparent from the following description of exemplary embodiments with reference to the attached drawings.

BRIEF DESCRIPTION OF THE DRAWINGS

FIG. 3A and FIG. 3B are tables showing a processing overview according to a comparative example;

FIG. 4A and FIG. 4B are tables showing a processing overview according to an example;

FIG. 5A and FIG. 5B are tables showing a processing overview according to a comparative example; and FIG. 6A and FIG. 6B are tables showing a processing overview according to an example.

DESCRIPTION OF THE EMBODIMENTS

Example 1

Figure 1:
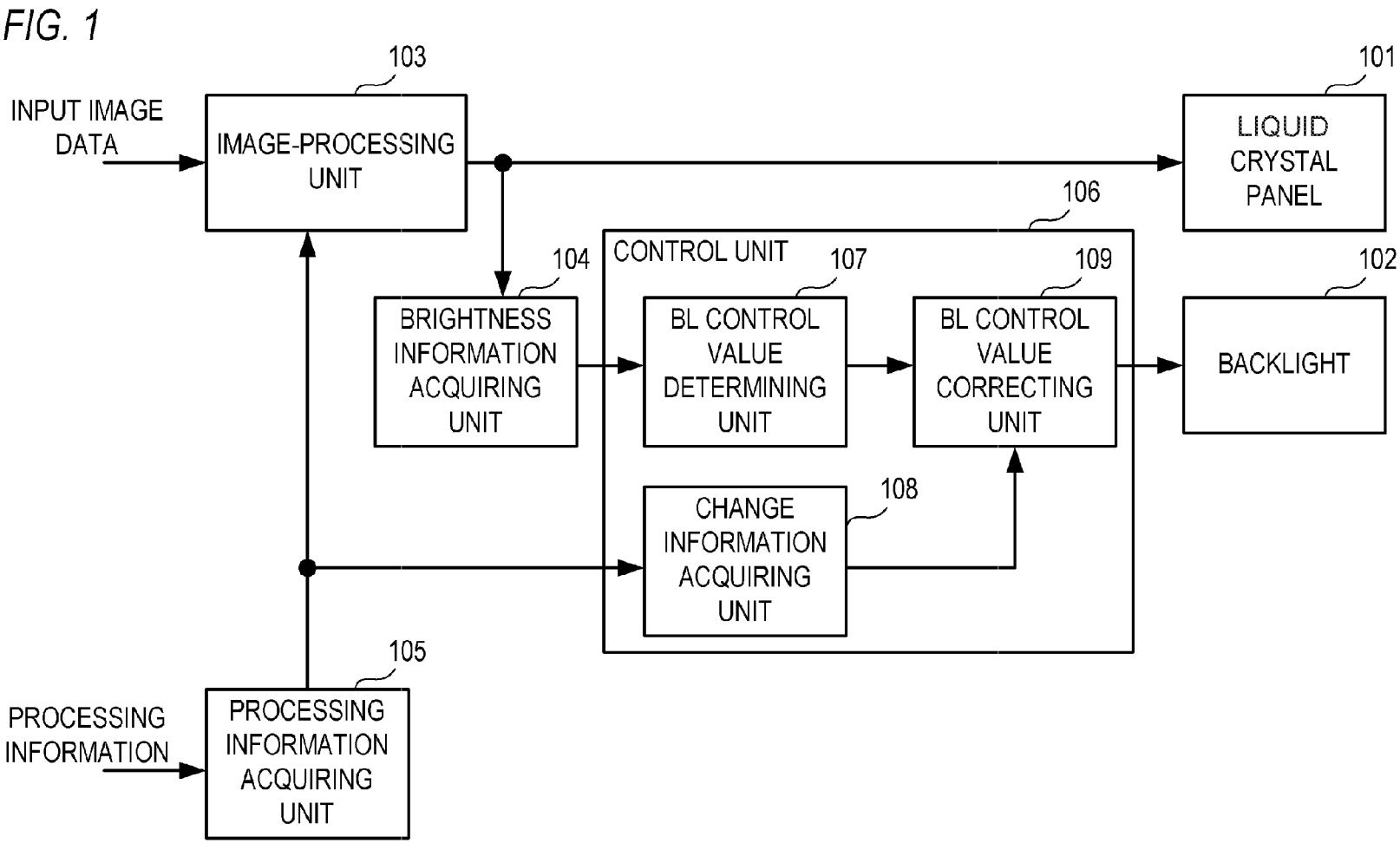
FIG. 1 is a block diagram depicting a configuration of an image display apparatus according to an example.

An image display apparatus according to Example 1 of the present invention and a control method thereof will now be described.

In Example 1, a case where the image display apparatus is a transmission type liquid crystal display apparatus will be described. The transmission type liquid crystal display apparatus includes a backlight and a liquid crystal panel configured to display an image on the screen by transmitting light from the backlight based on image data. However the image display apparatus is not limited to a transmission type liquid crystal display apparatus. The image display apparatus can be any image display apparatus constituted by a light-emitting unit and a display unit configured to display an image on the screen by modulating the light from the light-emitting unit based on the image data. For example, the image display apparatus may be a reflection type liquid crystal display apparatus. Further, the image display apparatus may be a micro electro mechanical system (MEMS) shutter type display using MEMS shutters instead of liquid crystal elements.

(Processing Overview 1)

A processing overview of the image display apparatus according to Example 1 and a comparative example thereof will be described. Here a case of performing color change processing, which is an image processing to change a color of an image, is described. In concrete terms, an example of performing a color temperature change processing, to change the color temperature of white to a target temperature (target color temperature), is described. Here a case of not performing global dimming control and local dimming control is described. The global dimming control and the local dimming control are backlight controls to control the BL brightness (emission brightness of the backlight) to a target value according to the brightness of the input image data. In the global dimming control, the BL brightness is controlled to a same value throughout the screen. In the local dimming control, the BL brightness is individually controlled for each of a plurality of light emitting regions on the screen.

If a color of the image data is changed, the brightness and dynamic range of the image data change. If the brightness and dynamic range of the image data change, then the brightness and contrast of a display image changes. The display image is an image displayed on the screen. The dynamic range of the image data is a range possible for a pixel value of the image data. The contrast of the display image is a ratio of the maximum value and the minimum value possible for the display brightness (brightness on the screen, brightness of the display image). In concrete terms, contrast is a ratio of the display brightness of white and the display brightness of black. Contrast includes temporal contrast and spatial contrast. The temporal contrast is a ratio of the display brightness of a black image and the display brightness of a white image, and the spatial contrast is a ratio of the display brightness of a black region and the display brightness of a white region within one image. Here a case where a pixel value of image data is an RGB value (combination of an R value, G value and B value) will be considered. In this case, for a pixel of which R value=G value=B value=upper limit value, the color of the pixel is changed by changing at least one of the R value, G value and B value to a value smaller than the upper limit value. By dropping the gradation value like this, the brightness and dynamic range of the image data drop. As a result, the brightness and contrast of the display image drop.

(Processing Overview 1 According to Comparative Example)

As a comparative example, a case of changing the BL brightness, so as to maintain the display brightness of white, will be described. FIG. 3A and FIG. 3B are tables showing various values according to the comparative example. FIG. 3A shows the target temperature, the color of the image data (image color), the pixel value, the BL brightness and the display brightness. FIG. 3B shows the target temperature and the contrast of the display image.

First a case where the color temperature Temp_D65 of the light emitted from a D65 light source is set as the target temperature is considered. In this case, as shown in FIG. 3A, (R value, G value, B value)=(100%, 100%, 100%) is used as the pixel value of white, and (0%, 0%, 0%) is used as the pixel value of black. In the comparative example, the BL brightness is set to 100% regardless what image data is displayed. Thereby 100% is acquired as the display brightness of white, and 0.1% is acquired as the display brightness of black. The display brightness of black is not 0% because the liquid crystal panel cannot completely block light from the backlight, and light from the backlight leaks from the screen. As a result, as shown in FIG. 3B, 1000 (=display brightness of white: 100%/display brightness of black: 0.1%) is acquired as the contrast of the display image.

Now a case where the target temperature is changed from the color temperature Temp_D65 to the color temperature Temp_D50 is considered. The color temperature Temp_D50 is the color temperature of light emitted from a D50 light source. In this case, as shown in FIG. 3A, (100%, 90%, 66%) is used as the pixel value of white, and (0%, 0%, 0%) is used as the pixel value of black. Thus in a case where the target temperature is changed, the G value and B value corresponding to white are decreased to values less than 100%. Therefore if the BL brightness is always controlled to a same value (100%), the display brightness of white drops, and the contrast of the display image drops in a case where the target temperature is changed. Hence according to the comparative example, the BL brightness is controlled to a value which suppresses the drop in the display brightness of white, regardless what image data is displayed. In concrete terms, the BL brightness is increased from 100% to 110%. As a result, the display brightness of white can be maintained at 100%. However, if the BL brightness is increased from 100% to 110%, the display brightness of black increases from 0.1% to 0.11%. Therefore as shown in FIG. 3B, the contrast of the display image drops from 1000 to 900 in a case where the target temperature is changed. In concrete terms, both the temporal contrast and spatial controls drop from 1000 to 900.

(Processing Overview 1 According to Example 1)

A processing overview according to Example 1 will now be described. FIG. 4A and FIG. 4B are tables showing various values according to Example 1, Example 2 and a modification of the present invention. Out of the values shown in FIG. 4A and FIG. 4B, the values related to Example 1 will be described herein below. FIG. 4A shows the target temperature, the image color, the BL brightness and the display brightness. FIG. 4B shows the target temperature and the contrast of the display image. The values in the case where the target temperature is the color temperature Temp_D65 are the same as the comparative example (FIG. 3A and FIG. 3B). Therefore description for the case where the target temperature is the color temperature Temp_D65 is omitted.

A case where the target temperature is changed from the color temperature Temp_D65 to the color temperature Temp_D50 is considered. In Example 1, the BL brightness is controlled to a value that depends on the brightness of the display target image data, so as to suppress the drop in contrast caused by the color temperature change processing. In concrete terms, the BL brightness is not changed in a case where the image data of white is displayed, and the BL brightness is decreased in a case where the image data of black is displayed. In the case of FIG. 4A, the BL brightness is maintained at 100% in a case where the image data of white is displayed, and the BL brightness is decreased from 100% to 90% in a case where the image data of black is displayed. Thereby 90% is acquired as the display brightness of white, and 0.09% is acquired as the display brightness of black. As a result, as shown in FIG. 4B, 1000 (=display brightness of white: 90%/display brightness of black: 0.09%) is acquired as the contrast of the display image, and the drop in contrast caused by the color temperature change processing can be suppressed. In concrete terms, a drop in temporal contrast can be suppressed.

FIG. 4A and FIG. 4B show a case where the same contrast can be acquired regardless the target temperature, but the present invention is not limited to this. For example, in a case where the target temperature is the color temperature Temp_D50 and the image color is black, the BL brightness may be controlled to a value higher than 90%, or may be controlled to a value lower than 90%. The BL brightness can be controlled to any value as long as the change amount of the contrast is smaller than the case of always controlling the BL brightness to be the same value. The contrast of the display image may be decreased or increased from a reference contrast. The reference contrast is, for example, a contrast in a case where the target temperature is the color temperature Temp_D65 and the BL brightness is 100%.

(Processing Overview 2)

Another processing overview of the image display apparatus according to Example 1 and a comparative example thereof will be described. Here a case of performing global dimming control, to control the BL brightness to a higher value as the brightness of the input image data becomes higher, will be described.

(Processing Overview 2 According to Comparative Example)

As a comparative example, a case of changing the BL brightness, so as to maintain the display brightness of white, will be described. FIG. 5A and FIG. 5B are tables showing various values according to the comparative example. FIG. 5A shows the target temperature, the image color, the pixel value, the BL brightness and the display brightness. FIG. 5B shows the target temperature and the contrast of the display image.

First a case where the color temperature Temp_D65 of the light emitted from the D65 light source is set as the target temperature is considered. In this comparative example, as shown in FIG. 5A, the BL brightness is controlled to 100% in a case where the image data of white is displayed, and the BL brightness is controlled to 50% in a case where the image data of black is displayed (global dimming control). Thereby 100% is acquired as the display brightness of white, and 0.05% is acquired as the display brightness of black. As a result, as shown in FIG. 5B, 2000 (=display brightness of white: 100%/display brightness of black: 0.05%) is acquired as the contrast of the display image.

Now a case where the target temperature is changed from the color temperature Temp_D65 to the color temperature Temp_D50 is considered. In this comparative example, the BL brightness is increased at a same increase rate regardless what image data is displayed. In concrete terms, the BL brightness is increased at an increase rate that suppresses the drop in the display brightness of white. In the case of FIG. 5A, 1.1 is used as the increase rate. Therefore the BL brightness is controlled to 110% in a case where the image data of white is displayed, and the BL brightness is controlled to 55% in a case where the image data of black is displayed. As a result, the display brightness of white is maintained at 100%. However if the BL brightness is increased from 50% to 55%, the display brightness of black increases from 0.05% to 0.055%. Therefore as shown in FIG. 5B, the contrast of the display image drops from 2000 to 1818 in a case where the target temperature is changed. In concrete terms, both the temporal contrast and the spatial contrast drop from 2000 to 1818. This problem (drop in contrast) also occurs in a case where the local dimming control is performed.

(Processing Overview 2 According to Example 1)

Another processing overview according to Example 1 will be described next. FIG. 6A and FIG. 6B are tables showing various values according to Example 1, Example 2 and modifications of the present invention. Out of these values shown in FIG. 6A and FIG. 6B, the values related to Example 1 will be described herein below. FIG. 6A shows the target temperature, the image color, the pixel value, the BL brightness and the display brightness. FIG. 6B shows the target temperature and the contrast of the display image. The values in the case where the target temperature is the color temperature Temp_D65 is the same as the comparative example (FIG. 5A and FIG. 5B). Therefore description for the case where the target temperature is the color temperature Temp_D65 is omitted.

A case where the target temperature is changed from the color temperature Temp_D65 to the color temperature Temp_D50 is considered. As mentioned above, according to Example 1, the BL brightness is not changed in a case where the image data of white is displayed, and the BL brightness is decreased in a case where the image data of black is displayed. In the case of FIG. 6A, the BL brightness is maintained at 100% in a case where the image data of white is displayed, and the BL brightness is decreased from 50% to 45% in a case where the image data of black is displayed. Thereby 90% is acquired as the display brightness of white, and 0.045% is acquired as the display brightness of black. As a result, as shown in FIG. 6B, 2000 (=display brightness of white: 90%/display brightness of black: 0.045%) is acquired as the contrast of the display image, and a drop in contrast caused by the color temperature change processing can be suppressed. In concrete terms, a drop in temporal contrast can be suppressed. This effect (maintaining temporal contrast) can also be implemented in a case where the local dimming control is performed. If the local dimming control is performed, 0.045% can be acquired as the display brightness in the black region of an image, and 90% can be acquired as the display brightness in the white region thereof. Hence if the local dimming control is performed, a drop in spatial contrast can also be suppressed.

(Configuration)

FIG. 1 is a block diagram depicting a configuration of the image display apparatus according to Example 1. As shown in FIG. 1, the image display apparatus according to Example 1 includes a liquid crystal panel 101, a backlight 102, an image-processing unit 103, a brightness information acquiring unit 104, a processing information acquiring unit 105, and a control unit 106.

The backlight 102 is a light-emitting unit that emits light. The backlight 102 is disposed on the rear face side of the liquid crystal panel 101, and irradiates the rear surface of the liquid crystal panel 101 with light. In Example 1, the backlight 102 has a configuration to execute the local dimming control. In concrete terms, the backlight 102 has a plurality of light source units which correspond to the plurality of light emitting regions respectively. The BL brightness can be individually controlled for each of the plurality of light source units. Each light source unit has one or more light-emitting element(s). For the light-emitting element, a light emitting diode (LED), an organic EL element, a cold cathode tube or the like can be used. And each light source unit emits light at the BL brightness corresponding to a BL control value T output from the control unit 106.

Figure 2:
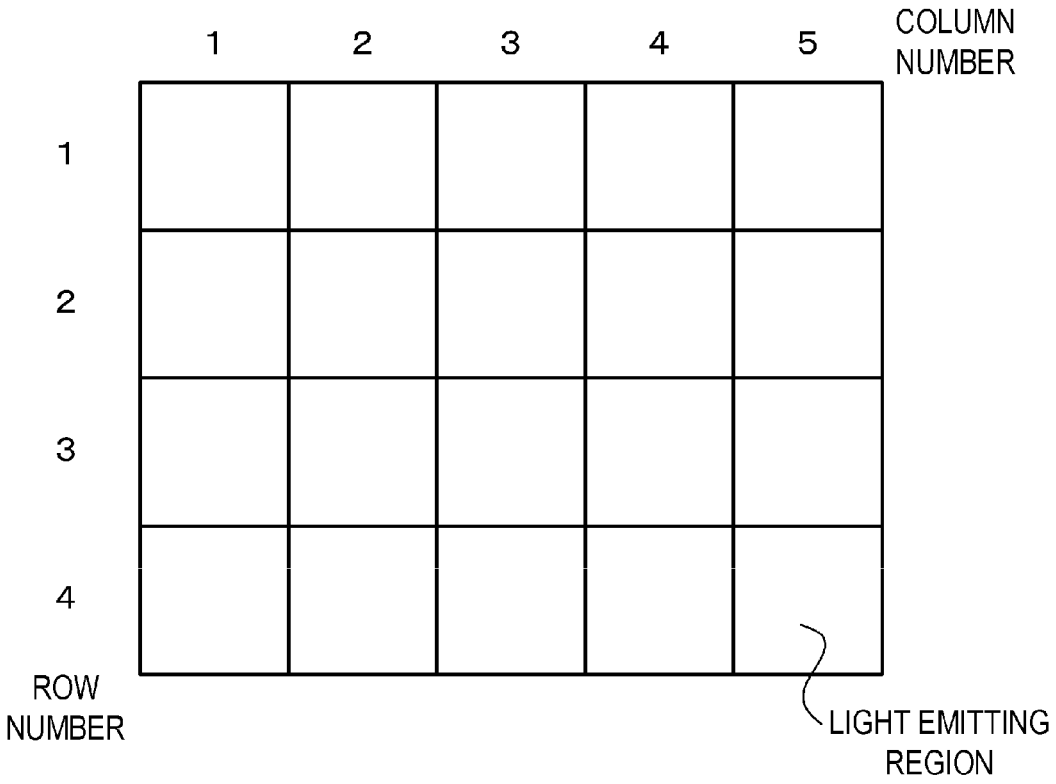
FIG. 2 is a diagram depicting a plurality of light emitting regions according to an example.

FIG. 2 is a diagram depicting an example of the plurality of light emitting regions. In the case of FIG. 2, the screen region is constituted by 20 light emitting regions (4 rows×5 columns). In Example 1, the BL control value T corresponding to a light emitting region in the m-th row and the n-th column is denoted by "Tmn". The light source unit corresponding to the light emitting region at the m-th row and the n-th column emits light at the BL brightness corresponding to the BL control value Tmn.

The number of the light emitting regions and the number of the light source units may be more or less than 20. The number of light emitting regions in the row direction or column direction may be one.

The plurality of light emitting regions need not be a plurality of regions disposed in a matrix. For example, the plurality of light emitting regions may be a plurality of regions disposed in a zigzag grid formation.

The plurality of light emitting regions need not be a plurality of regions constituting the region on the screen. For example, at least a part of a light emitting region may overlap with at least a part of another light emitting region. A light emitting region may be distant from another light emitting region.

The shape of a light emitting region need not be a square. For example, the shape of a light emitting region may be a triangle, pentagon, hexagon, circle or the like.

The liquid crystal panel 101 is a display unit that displays an image on the screen by modulating the light from the backlight 102 based on the image data input to the liquid crystal panel 101. In concrete terms, the liquid crystal panel 101 has a plurality of liquid crystal elements. The transmittance of each liquid crystal element is controlled to a value corresponding to the image data input to the liquid crystal panel 101. The light from the backlight 102 transmits through each liquid crystal element at a transmittance corresponding to the image data input to the liquid crystal panel 101, whereby the image is displayed on the screen. For example, the liquid crystal panel 101 has three types of liquid crystal elements (R element, G element, B element) for each pixel. The R element is a liquid crystal element corresponding to red, the G element is a liquid crystal element corresponding to green, and the B element is a liquid crystal element corresponding to blue. For example, the transmittance of the R element is controlled to a value corresponding to the R value of the image data, the transmittance of the G element is controlled to a value corresponding to the G value of the image data, and the transmittance of the B element is controlled to a value corresponding to the B value of the image data.

The processing information acquiring unit 105 acquires processing information, which is information on image processing performed by the image-processing unit 103. Then the processing information acquiring unit 105 outputs the acquired processing information to the image-processing unit 103 and the control unit 106. In Example 1, parameters used for the image processing are acquired as the processing information. The processing information is acquired according to, for example, user operation for the image display apparatus, operation environment of the image display apparatus and the like.

The image-processing unit 103 is a functional unit that executes image processing which may drop the dynamic range of the image data. According to Example 1, the image-processing unit 103 acquires image data (acquired image data) by executing image processing corresponding to the processing information output from the processing information acquiring unit 105. In concrete terms, the image data is acquired by executing image processing using the parameters output from the processing information acquiring unit 105. In Example 1, color temperature change processing is performed as the image processing. The image-processing unit 103 outputs the acquired image data to the brightness information acquiring unit 104 and the liquid crystal panel 101. Therefore according to Example 1, the transmittance of the liquid crystal panel 101 is controlled based on the acquired image data.

If predetermined reference parameters are acquired, image data the same as the input image data is generated as the acquired image data by performing the color temperature change processing on the input image data using the reference parameters. In other words, if the reference parameters are acquired, the color temperature change processing, which drops the dynamic range of the image data, is not performed, and the color temperature change processing, which does not change the image data, is performed. If parameters different from the reference parameters are acquired, the color temperature change processing using the acquired parameters is performed on the input image data, whereby processed image data, of which dynamic range is smaller than that of the input image data, is generated as the acquired image data.

If the reference parameters are acquired, the input image data may be output as the acquired image data, omitting the color temperature change processing.

The image-processing unit 103 may be disposed in an apparatus (external apparatus) that is separate from the image display apparatus. If the image-processing unit 103 is disposed on the external apparatus and the color temperature change processing is performed using the reference parameters, the processing information need not be acquired.

The brightness information acquiring unit 104 acquires brightness information, which is information on the brightness of the acquired image data output from the image-processing unit 103, from the acquired image data. Then the brightness information acquiring unit 104 outputs the acquired brightness information to the control unit 106.

In Example 1, the brightness information acquiring unit 104 converts each pixel value of the acquired image data into a brightness value. If the pixel value of the acquired image data is an RGB value, the RGB value can be converted into the brightness value Y using the following Expression 1. In Expression 1, "R" denotes the R value, "G" denotes the G value, and "B" denotes the B value. "α", "β" and "γ" denote the conversion coefficients to convert the RGB value into the brightness value, and are predetermined values.

$$Y=\alpha\times R+\beta\times G+\gamma+B \quad \text{(Expression 1)}$$

In Example 1, the brightness information acquiring unit 104 calculates, for each of a plurality of light emitting regions, as the brightness information, the average value YAG of the brightness values Y of the acquired image data in the light emitting region. In Example 1, the average brightness value YAG corresponding to the light emitting region in the m-th row and n-th column is denoted as "YAGmn". Thus in Example 1, the brightness information on the brightness of the acquired image data is acquired for each of the plurality of light emitting regions respectively.

The pixel value of the acquired image data is not limited to an RGB value. For example, the pixel value of the acquired image data may be a YCbCr value. In this case, the Y value can be acquired from the YCbCr value.

The method for acquiring the brightness information is not limited to the above method. Brightness information different from the average brightness value YAG may be acquired. For example, the maximum value, the minimum value, the mode, the median, the histogram or the like of the brightness values of the acquired image data may be acquired as the brightness information. Further, the average value, the maximum value, the minimum value, the mode, the median, the histogram or the like of the pixel values of the acquired image data may be acquired as the brightness information. The brightness information on the brightness of the entire image may be acquired.

The control unit 106 controls the BL brightness based on the brightness information output from the brightness information acquiring unit 104 and the processing information output from the processing information acquiring unit 105. In Example 1, for each of the plurality of light emitting regions, the BL brightness of the light source corresponding to the light emitting region is controlled based on the processing information and the brightness information corresponding to the light emitting region. In Example 1, the BL brightness can be controlled using the brightness information and the processing information, so as to suppress the drop in contrast caused by the color temperature change processing, in a case where the acquired image data is the processed image data. The processed image data is image data in which the dynamic range has been dropped by the color temperature change processing, as mentioned above.

As shown in FIG. 1, the control unit 106 includes a BL control value determining unit 107, a change information acquiring unit 108, and a BL control value correcting unit 109.

Based on the processing information, the change information acquiring unit 108 acquires change information, which is information on the change amount (decrease amount) of contrast caused by the color temperature change processing. Then the change information acquiring unit 108 outputs the acquired change information to the BL control value correcting unit 109. In Example 1, the change information Y_o is calculated using the following Expression 2.

[Math. 1]

$$\text{Y_o} = MTX\begin{pmatrix} rgain \\ ggain \\ bgain \end{pmatrix} \quad \text{(Expression 2)}$$

$$MTX = (\text{YR_mtx YG_mtx YB_mtx})$$

In Expression 2, each element (YR_mtx, YG_mtx and YB_mtx) of the matrix MTX can be calculated using the following Expression 3 to 5.

$$YR_mtx = yr \times R_\text{coe}/YM \quad \text{(Expression 3)}$$

$$YG_mtx = yg \times G_\text{coe}/YM \quad \text{(Expression 4)}$$

$$YB_mtx = yb \times B_\text{coe}/YM \quad \text{(Expression 5)}$$

In Expressions 4 and 5, R_coe, G_coe, B_coe and YM can be calculated using the following Expressions 6 to 8.

[Math. 2]

$$\begin{pmatrix} \text{R_coe} \\ \text{G_coe} \end{pmatrix} = \begin{pmatrix} xr - xb & xg - xb \\ yr - yb & yg - yb \end{pmatrix}\begin{pmatrix} xw - xb \\ yw - yb \end{pmatrix} \quad \text{(Expression 6)}$$

$$\text{B_coe} = 1 - \text{R_coe} - \text{G_coe} \quad \text{(Expression 7)}$$

$$YM = yr \times \text{R_coe} + yg \times \text{G_coe} + yb \times \text{B_coe} \quad \text{(Expression 8)}$$

rgain denotes a coefficient (processing information: parameter) by which the R value is multiplied in the color temperature change processing, ggain denotes a coefficient by which the G value is multiplied in the color temperature change processing, and bgain denotes a coefficient by which the B value is multiplied in the color temperature change processing.

xr, xg, xb and xw are reference values of the x value in the XYZ color system, and yr, yg, yb and yw are the reference values of the y value in the XYZ color system. The x value xr and the y value yr are values corresponding to the display colors (colors on screen: colors of the display image) in a case where the red image data (R value≠0 and G value=B value=0) is displayed. The x value xg and the y value yg are values corresponding to the display colors in a case where the green image data (G value≠0 and R value=B value=0) is displayed. The x value xb and the y value yb are values corresponding to the display colors in a case where the blue image data (B value≠0 and R value=G value=0) is displayed. The x value xw and the y value yw are values corresponding to the display colors in a case where the white image data (R value=G value=B value≠0) is displayed.

According to the above mentioned Expression 4, the change information Y_o on the decrease amount of contrast can be acquired based on the reference values of the x value and the y value in the XYZ color system, and the balance of RGB values after the color temperature change processing. In Example 1, for the change information Y_o, a lower value is acquired as the decrease amount of contrast is greater, and a higher value is acquired as the decrease amount of contrast is smaller. If contrast was not dropped by the color temperature change processing, the change information Y_o=1 is acquired. Therefore in Example 1, a value greater than 0 and not greater than 1 is acquired as the change information Y_o.

In the image display apparatus, the processing to calculate the matrix MTX may or may not be performed. The matrix MTX shows values unique to the apparatus, and can be provided in advance.

According to Example 1, the BL brightness is controlled based on the brightness information (average brightness value YAG) and the change information Y_o. In Example 1, the target brightness (target value of BL brightness) is determined according to the average brightness value YAG, and the target brightness is corrected based on the target brightness and the change information Y_o. By this two-step processing, the final target brightness is determined.

The method for determining the final target brightness is not especially limited. For example, the final target brightness may be determined by correcting the target brightness based on the average brightness value YAG and the change information Y_o. The final target brightness may also be determined by a one-step processing based on the average brightness value YAG and the change information Y_o, without determining the target brightness according to the average brightness value YAG.

The BL control value determining unit 107 determines the target brightness according to the brightness information (average brightness value YAG). In concrete terms, for each of the plurality of light emitting regions, the target brightness of the light source corresponding to the light emitting region is determined according to the average brightness YAG corresponding to the light emitting region. In Example 1, instead of the target brightness, the BL control value bd corresponding to the target brightness is calculated according to the average brightness value YAG. The BL control value bd is a BL control value to control the BL brightness of the light source to the target brightness. The BL control value determining unit 107 outputs the determined target brightness (BL control value bd) to the BL control value correcting unit 109. In this example, the BL control value bd corresponding to a light emitting region in the m-th row and n-th column is denoted as "bdmn". The BL control value bdmn can be calculated using the following Expression 9, for example.

$$bdmn = YAGmn/Ymax \quad \text{(Expression 9)}$$

In Expression 9, "Ymax" is a maximum value of the values possible for the brightness value or the average brightness value (maximum brightness value). If a value possible for the brightness value is an integer in the 0 to 255 range, the maximum brightness value Ymax is 255. If Expression 9 is used, the calculated BL control value bd becomes higher as the average brightness value YAG is higher. Further, if Expression 9 is used, a value in the 0 to 1 range is calculated as the BL control value bd.

The method for determining the BL control value bd is not especially limited. For example, a value the same as the average brightness value YAG may be determined as the BL control value bd. A value the same as the average brightness value YAG may be determined as the target brightness. A value greater than the average brightness value YAG may be determined as the target brightness, or a value smaller than the average brightness value YAG may be determined as the target brightness value.

The BL control value correcting unit 109 corrects the BL control value bd based on the BL control value bd and the change information Y_o, so as to suppress the drop in contrast caused by the color temperature change processing. Thereby the BL control value T corresponding to the target brightness after correction is acquired. In this example, the BL control value Tmn is acquired by correcting the BL control value bdmn, based on the BL control value bdmn and the change information Y_o. Then the BL control value correcting unit 109 outputs the BL control value T to the backlight 102. Thereby the BL brightness is controlled to a value corresponding to the BL control value T (target brightness after correction).

According to Example 1, a value smaller than the BL control value bd is calculated as the BL control value T in a case where the change information Y_o is smaller than 1 and the BL control value bd is smaller than the reference value R. In this case, a lower value is calculated as the BL control value T as the change information Y_o is smaller. In Example 1, the reference value R corresponding to the light emitting region in the m-th row and n-th column is denoted as "Rmn".

According to Example 1, in a case other than the above case, the BL control value bd is not corrected, and a value the same as the BL control value bd is acquired as the BL control value T. For example, in a case where the change information Y_o is smaller than 1 and the BL control value bd is the reference value R or more, the BL control value bd is acquired as the BL control value T. In a case where the change information Y_o is 1 as well, the BL control value bd is acquired as the BL control value T.

In concrete terms, according to Example 1, the BL control value Tmn is calculated using the following Expression 10 if the BL control value bdmn is smaller than the reference value Rmn. If the BL control value bdmn is the reference value Rmn or more, on the other hand, the BL control value Tmn is calculated using the following Expression 11.

$$Tmn = Y_o \times bdmn \quad \text{(Expression 10)}$$

$$Tmn = bdmn \quad \text{(Expression 11)}$$

According to the above processing, if the acquired image data is the processed image data and the brightness of the acquired image data is lower than the reference value, the BL brightness is controlled to a lower value as the decrease amount of contrast by the color change processing is greater. In a case other than the above case, the BL brightness is controlled to a value corresponding to the BL control value bd. As a result, a drop in temporal contrast caused by the color temperature change processing can be suppressed based on the principle described with reference to FIG. 4A, FIG. 4B, FIG. 6A and FIG. 6B. Further, in Example 1, the BL brightness in each light emitting region is individually controlled, hence a drop in spatial contrast caused by the color temperature change processing can also be suppressed. Furthermore, in Example 1, the local dimming control (processing to individually determine the BL control value bd of each light source according to the brightness of the acquired image data) is performed, hence a display image with higher temporal and spatial contrasts can be acquired.

The reference value R can be any value. A plurality of reference values R corresponding to the plurality of light emitting regions (light sources) respectively may be used, or one common reference value R may be used for the plurality of light emitting regions (light sources). For the reference value R, a non-LD value BL_NLD, a reference white value BL_W, a reference black value BL_B or the like may be used. The non-LD value BL_NLD is a BL control value bd which is used in a case where neither the local dimming control nor the global dimming control is executed. The reference white value BL-W is a BL control value bd corresponding to a white image. If a value possible for the average brightness YAG is in a 0 to 255 range and the average brightness value YAG to be acquired is higher as the brightness of the image is higher, the reference white value BL_W is a BL control value bd corresponding to the average brightness value YAG=255. The reference black value BL_B is a BL control value bd corresponding to a black image. In a case where a value that the average brightness value YAG can accept is in a 0 to 255 range and the average brightness value YAG to be acquired is higher as the brightness of the image is higher, the reference black value BL_B is a BL control value bd corresponding to the average brightness value YAG=0. The reference value R may be determined and used based on the acquired image data. For example, as the average brightness value YAG is lower, a lower value may be used as the reference value R.

As described above, according to Example 1, the brightness information and the processing information are used in a case where the BL brightness is controlled. Thereby the change in contrast of the display image caused by the color temperature change processing can be suppressed. In concrete terms, a drop in contrast of the display image caused by the color temperature change processing can be suppressed.

The local dimming control need not be performed. The global dimming control (processing to determine a same BL control value bd for all the light sources according to the brightness of the acquired image data) may be performed. If the global dimming control is performed, a display image of which temporal contrast is higher can be acquired. The BL brightness may be controlled without performing the local dimming control or the global dimming control. Even if the local dimming control and the global dimming control are not performed, the change in contrast due to the change of dynamic range caused by the color temperature change processing can be suppressed by controlling the BL brightness using the brightness information and the processing information.

For the processing information, information other than parameters may be acquired. For example, information to indicate the type of the color temperature change processing may be acquired as the processing information. In this case, the image-processing unit 103 may select a parameter corresponding to the type of the color temperature change processing, out of a plurality of parameters, and execute the color temperature change processing using the selected parameters. The image-processing unit 103 may select an algorithm corresponding to the type of the color temperature change processing, out of a plurality of algorithms, and execute the color temperature change processing according to the selected algorithm. The change information acquiring unit 108 may select the change information corresponding to the type of the color temperature change processing, out of a plurality of change information, and output the selected change information. These various types of processing can be executed by preparing information (table) to indicate the correspondence of the types of the color temperature change processing, parameters (or algorithms) and the change information in advance.

The image processing is not limited to the temperature change processing. For example, color change processing other than the temperature change processing may be executed, or image processing other than the color change processing may be executed. A color gamut change processing to change the color gamut of the image into a target color gamut, blur processing to make the image blur, edge enhancing processing to enhance edges or the like may be executed. A plurality of types of image processing may be performed. According to Example 1, the change in contrast due to the change of the dynamic range caused by image processing can be suppressed regardless what image processing is performed.

As mentioned above, if the image-processing unit 103 is disposed in an external apparatus and the color temperature change processing is performed using reference parameters, the processing information need not be acquired. In the case of such a configuration, the change information Y_o=1 may be acquired since the processing information is not acquired. Further, the correction of the BL control value bd may be omitted since the processing information is not acquired.

The method for controlling the BL brightness is not limited to the above method. Any method to suppress a drop in contrast based on the principle described with reference to FIG. 4A, FIG. 4B, FIG. 6A and FIG. 6B may be used. This processing can be implemented by using the brightness information and the processing information. The BL brightness may also be controlled according to the modifications to be described herein below.

(Processing Overview 1 According to Modification)

A processing overview according to a modification of the present invention will now be described. Here a case of not performing the local dimming control and the global dimming control is described. Out of the values shown in FIG. 4A and FIG. 4B, the values related to the modification will be described herein below. The value in a case where the target temperature is the color temperature Temp_D65 are the same as the comparative example (FIG. 3A, FIG. 3B). Therefore description for the case where the target temperature is the color temperature Temp_D65 is omitted.

A case where the target temperature is changed from the color temperature Temp_D65 to the color temperature Temp_D50 is considered. In the modification, the BL brightness is not changed in a case where the image data of black is displayed, and the BL brightness is increased in a case where the image data of white is displayed. In the case of FIG. 4A, the BL brightness is increased from 100% to 110% in a case where the image data of white is displayed, and the BL brightness is maintained at 100% in a case where the image data of black is displayed. Thereby 100% is acquired as the display brightness of white, and 0.1% is acquired as the display brightness of black. As a result, as shown in FIG. 4B, 1000 (=display brightness of white: 100%/display brightness of black: 0.1%) is acquired as the contrast of the display image, and a drop in contrast caused by the color temperature change processing can be suppressed. In concrete terms, a drop in temporal contrast can be suppressed.

(Processing Overview 2 According to Modification)

Another processing overview according to a modification of the present invention will now be described. Here a case of performing the global dimming control is described. Out of the values shown in FIG. 6A and FIG. 6B, values related to the modification will be described herein below. The values in a case where the target temperature is the color temperature Temp_D65 are the same as the comparative example (FIG. 5A, FIG. 5B). Therefore description for the case where the target temperature is the color temperature Temp_D65 is omitted.

A case where the target temperature is changed from the color temperature Temp_D65 to the color temperature Temp_D50 is considered. As mentioned above, in the modification, the BL brightness is not changed in a case where the image data of black is displayed, and the BL brightness is increased in a case where the image data of white is displayed. In the case of FIG. 6A, the BL brightness is increased from 100% to 110% in a case where the image data of white is displayed, and the BL brightness is maintained at 50% in a case where the image data of black is displayed. Thereby 100% is acquired as the display brightness of white, and 0.05% is acquired as the display brightness of black. As a result, as shown in FIG. 6B, 2000 (=display brightness of white: 100%/display brightness of black: 0.05%) is acquired as the contrast of the display image, and a drop in contrast caused by the color temperature change processing can be suppressed. In concrete terms, a drop in temporal contrast can be suppressed.

This effect (maintaining temporal contrast) can also be implemented in a case where the local dimming control is performed. If the local dimming control is performed, 0.05% can be acquired as the display brightness in the black region of one image, and 100% can be acquired as the display brightness in the white region thereof. Hence if the local dimming control is performed, a drop in spatial contrast can also be suppressed.

If the acquired image data is the processed image data and the brightness of the acquired image data is a reference value or more, the BL brightness may be controlled to be a higher value as the decrease amount of contrast caused by the image processing is greater. The BL brightness may be controlled to a value corresponding to the BL control value bd in cases other than the above case. For example, the BL control value Tmn may be calculated using the following Expressions 12 and 13. In concrete terms, in a case where the BL control value bdmn is the reference value Rmn or more, the BL control value Tmn is calculated using the following Expression 12, and in a case where the BL control value bd is smaller than the reference value Rmn, the BL control value Tmn is calculated using the following Expression 13. According to this configuration, a drop in temporal contrast caused by the color temperature change process ing can be suppressed based on the above mentioned principle of the comparative example.

$$Tmn=(1/Y_o)\times bdmn \quad \text{(Expression 12)}$$

$$Tmn=bdmn \quad \text{(Expression 13)}$$

In Example 1, a case where the dynamic range of the image data is dropped by image processing, and contrast is dropped by the drop in the dynamic range was described, but the present invention is not limited to this. In some cases, the dynamic range of the image data may be increased by image processing and contrast may be increased by the drop in the dynamic range. If the BL brightness is controlled using the brightness information and the processing information, an increase in contrast caused by the image processing can also be suppressed. For example, if the acquired image data is the processed image data and the brightness of the acquired image data is the reference value or more, the BL brightness is controlled to be a lower value as the increase amount of contrast caused by the image processing is greater. In a case where the acquired image data is the processed image data and the brightness of the acquired image data is lower than the reference value, the BL brightness may be controlled to be a higher value as the increase amount of contrast caused by the image processing is greater. Thereby the increase of contrast caused by the image processing can be suppressed.

Example 2

An image display apparatus according to Example 2 of the present invention and a control method thereof will now be described. A difference of Example 2 from Example 1 is the method for controlling the BL brightness. The processing different from Example 1 will be described in detail herein below, and description for processing the same as Example 1 is omitted.

(Processing Overview 1 According to Example 2)

A processing overview according to Example 2 will now be described. Here an example of not performing the global dimming control and the local dimming control is described. Out of the values shown in FIG. 4A and FIG. 4B, values related to Example 2 will be described herein below. The values in a case where the target temperature is the color temperature Temp_D65 are the same as the comparative example (FIG. 3A, FIG. 3B). Therefore description for the case where the target temperature is the color temperature Temp_D65 is omitted.

A case where the target temperature is changed from the color temperature Temp_D65 to the color temperature Temp_D50 is considered. In Example 2, the BL brightness is increased in a case where the image data of white is displayed, and the BL brightness is decreased in a case where the image data of black is displayed. In the case of FIG. 4A, the BL brightness is increased from 100% to 105% in a case where the image data of white is displayed, and the BL brightness is decreased from 100% to 95% in a case where the image data of black is displayed. Thereby 95% is acquired as the display brightness of white, and 0.095% is acquired as the display brightness of black. As a result, as shown in FIG. 4B, 1000 (=display brightness of white: 95%/display brightness of black: 0.095%) is acquired as the contrast of the display image, and a drop in contrast caused by the color temperature change processing can be suppressed. In concrete terms, a drop in temporal contrast can be suppressed.

(Processing Overview 2 According to Modification)

Another processing overview according to Example 2 will be described. Here a case of performing the global dimming control is described. Out of the values shown in FIG. 6A and FIG. 6B, the values related to Example 2 will be described herein below. The values in a case where the target temperature is the color temperature Temp_D65 are the same as the comparative example (FIG. 5A, FIG. 5B). Therefore description for the case where the target temperature is the color temperature Temp_D65 is omitted.

A case where the target temperature is changed from the color temperature Temp_D65 to the color temperature Temp_D50 is considered. AS mentioned above, in Example 2, the BL brightness is increased in a case where the image data of white is displayed, and the BL brightness is decreased in a case where the image data of black is displayed. In the case of FIG. 6A, the BL brightness is increased from 100% to 105% in a case where the image data of white is displayed, and the BL brightness is decreased from 50% to 47.5% in a case where the image data of black is displayed. Thereby 95% is acquired as the display brightness of white, and 0.0475% is acquired as the display brightness of black. As a result, as shown in FIG. 6B, 2000 (=display brightness of white: 95%/display brightness of black: 0.0475%) is acquired as the contrast of the display image, and a drop in contrast caused by the color temperature change processing can be suppressed. In concrete terms, a drop in temporal contrast can be suppressed.

This effect (maintaining temporal contrast) can al so be implemented in a case where the local dimming control is performed. If the local dimming control is performed, 0.0475% can be acquired as the display brightness of the black region of one image, and 95% can be acquired as the display brightness in the white region thereof. Hence if the local dimming control is performed, a drop in spatial contrast can also be suppressed.

The configuration of the image display apparatus according to Example 2 is the same as Example 1 (FIG. 1). A difference of Example 2 from Example 1 is the processing by the BL control value correcting unit 109. The BL control value correcting unit 109 of Example 2 will be described in detail herein below, and description on the other functional units, which is the same as Example 1, is omitted.

According to Example 2, a value smaller than the BL control value bd is calculated as the BL control value T in a case where the change information Y_o is smaller than 1, and the BL control value bd is smaller than the reference value R. In this case, a lower value is calculated as the BL control value T as the change information Y_o is smaller.

According to Example 2, a value greater than the BL control value bd is calculated as the BL control value T in a case where the change information Y_o is smaller than 1, and the BL control value bd is the reference value R or more. In this case, a higher value is calculated as the BL control value T as the change information Y_o is smaller.

According to Embodiment 2, in a case other than the above case, the BL control value bd is not correct, and a value the same as the BL control value bd is acquired as the BL control value T.

In concrete terms, according to Embodiment 2, the BL control value Tmn is calculated using the following Expression 14 if the BL control value bdmn is smaller than the reference value Rmn. If the BL control value bdmn is the reference value Rmn or more, on the other hand, the BL control value Tmn is calculated using the following Expression 15.

$$Tmn=Y_o\times bdmn \quad \text{(Expression 14)}$$

$$Tmn=(1/Y_o)bdmn \quad \text{(Expression 15)}$$

According to the above processing, if the acquired image data is the processed image data and the brightness of the acquired image data is lower than the reference value, the BL brightness is controlled to a lower value as the decrease amount of contrast caused by the color change process is greater. If the acquired image data is the processed image data and the brightness of the acquired image data is the reference value or more, the BL brightness is controlled to a higher value as the decrease amount of the contrast caused by the color change processing is greater. In a case other than the above cases, the BL brightness is controlled to a value corresponding to the BL control value bd. As a result, a drop in temporal contrast caused by the color temperature change processing can be suppressed based on the principle of Example 2 described with reference to FIG. 4A, FIG. 4B, FIG. 6A and FIG. 6B. Further, in Example 2, the BL brightness in each light emitting region is individually controlled, hence a drop in spatial contrast caused by the color temperature change processing can also be suppressed. Furthermore, in Example 2, the local dimming control is performed, hence a display image with higher temporal and spatial contrasts can be acquired.

As described above, according to Example 2, if the acquired image data is the processed image data and the brightness of the acquired image data is lower than the reference value, the BL brightness is controlled to a lower value as the decrease amount of contrast by the color change processing is greater. If the acquired image data is the processed image data and the brightness of the acquired image data is the reference value or more, the BL brightness is controlled to a higher value as the decrease amount of the contrast caused by the color change processing is greater. Thereby a drop in contrast of the display image caused by the color temperature change processing can be suppressed.

The BL brightness has an upper limit value, and in some cases the target brightness corresponding to the BL control value T calculated by Expression 15 may exceed the upper limit value. For example, if the decrease amount of contrast is very large, the target brightness corresponding to the BL control value T calculated by Expression 15 exceeds the upper limit value. In this case, the contrast drops because the BL brightness is limited to the upper limit value. Therefore in such a case, it is preferable to change the method of correcting the BL control value bd so that the BL control value T is determined by the method of Example 1. In concrete terms, the method for correcting the BL control value bd is changed to a method in which a BL control value T, that is smaller than the BL control value bd, is determined in a case where the BL control value bd is smaller than the reference value R, and a BL control value T, the same as the BL control value bd, is determined in other cases. By changing to the method of Example 1, the display brightness will drop, but the drop in contrast can be suppressed with certainty.

Example 3

An image display apparatus according to Example 3 of the present invention and a control method thereof will now be described. In Example 3, a case of performing a color gamut change processing as the image processing will be described. Processing different from Examples 1 and 2 will be described in detail herein below, and description for the processing that is the same as Examples 1 and 2 is omitted.

The configuration of the image display apparatus according to Example 3 is the same as Examples 1 and 2 (FIG. 1). A difference of Example 3 from Examples 1 and 2 is the processing by the change information acquiring unit 108. The change information acquiring unit 108 will be described in detail herein below, and description on the other functional units, which is the same as Examples 1 and 2, is omitted.

In a case where the color gamut processing is performed, not only the chromaticity of white but also the chromaticity of red, green, blue or the like also changes. The change information acquiring unit 108 of Example 3 acquires the change information considering these changes of the target values of various colors. For example, instead of the reference values xr, xg, xb, xw, yr, yg, yb and yw described in Example 1, the target values thereof are used, whereby the change information Y_o, considering the target values of the various colors, can be acquired using the same method as Example 1. The target values of the reference values xr, xg, xb, xw, yr, yg, yb and yw are included in the processing information, for example. For the coefficients rgain, ggain and bgain, coefficients by which the pixel value of white is multiplied are used, for example.

As described above, according to Example 3, the change information accurately representing the change amount of contrast caused by the color gamut change processing is acquired, and the BL brightness is controlled using the same method as Examples 1 and 2. Thereby the change in contrast caused by the color gamut change processing can be suppressed.

Other Embodiments

Embodiment (s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment (s) and/or that includes one or more circuits (e.g., application specific integrated circuit (ASIC)) for performing the functions of one or more of the above-described embodiment (s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to readout and execute the computer executable instructions.

The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-047279, filed on Mar. 10, 2015, which is hereby incorporated by reference herein in its entirety.

What is claimed is:

1. An image display apparatus, comprising:

a light-emitting unit;

a display unit configured to display an image on a screen by modulating light from the light-emitting unit based on image data;

a first acquiring unit configured to acquire brightness information on brightness of the image data;

an image-processing unit configured to perform age processing on input image data;

a second acquiring unit configured to acquire parameters used for the image processing; and a control unit configured to control emission brightness of the light-emitting unit based on the brightness information and the parameters, so as to suppress a change in contrast of an image, which is displayed on the screen, caused by the image processing.

2. The image display apparatus according to claim 1, wherein the light-emitting unit includes a plurality of light source units corresponding to a plurality of light emitting regions on the screen, respectively, the first acquiring unit acquires, for each of the plurality of light emitting regions, brightness information on the brightness of the image data in the light emitting region, and the control unit controls, for each of the plurality of light emitting regions, the emission brightness of the light source unit corresponding to the light emitting region based on the parameters and the brightness information corresponding to the light emitting region.

3. The image display apparatus according to claim 1, wherein the image processing is image processing which drops a dynamic range of the image data.

4. The image display apparatus according to claim 3, wherein in a case where the brightness of the image data is lower than a reference value, the control unit controls the emission brightness to be a lower value as a decrease amount of the contrast caused by the image processing is greater.

5. The image display apparatus according to claim 3, wherein in a case where the brightness of the image data is a reference value or higher, the control unit controls the emission brightness to be a higher value as a decrease amount of the contrast caused by the image processing is greater.

6. The image display apparatus according to claim 1, wherein the control unit includes:

a determining unit configured to determine a target value of the emission brightness according to the brightness information; and a correcting unit configured to correct the target value based on the brightness information and the parameters, or based on the target value and the parameters, so as to suppress the change in the contrast of the image, which is displayed on the screen, caused by the image processing.

7. The image display apparatus according to claim 1, wherein the control unit controls the emission brightness of the light-emitting unit based on the brightness information and the parameters, so that the contrast of the image displayed on the screen is not changed by the image processing.

8. The image display apparatus according to claim 1, wherein the parameters include a parameter relating to a red value R, a parameter relating to a green value G, and a parameter relating to a blue value B.

9. The image display apparatus according to claim 1, wherein the image processing is processing to change a color of an image.

10. The image display apparatus according to claim 1, wherein the image processing is processing to change a color temperature of white to a target color temperature.

11. The image display apparatus according to claim 1, wherein the image processing is processing to change a color gamut of an image to a target color gamut.

12. An image display apparatus, comprising:

a light-emitting unit;

a display unit configured to display an image on a screen by modulating light from the light-emitting unit based on image data;

a first acquiring unit configured to acquire brightness information on brightness of the image data;

an image-processing unit configured to perform image processing on input image data;

a second acquiring unit configured to acquire change information, which is information on a change amount of contrast of an image, which is displayed on the screen, caused by the image processing; and a control unit configured to control emission brightness of the light-emitting unit based on the brightness information and the change information, so as to suppress a change in the contrast caused by the image processing.

13. The image display apparatus according to claim 12, wherein the light-emitting unit includes a plurality of light source units corresponding to a plurality of light emitting regions on the screen, respectively, the first acquiring unit acquires, for each of the plurality of light emitting regions, brightness information on the brightness of the image data in the light emitting region, and the control unit controls, for each of the plurality of light emitting regions, the emission brightness of the light source unit corresponding to the light emitting region based on the change information and the brightness information corresponding to the light emitting region.

14. The image display apparatus according to claim 12, wherein the image processing is image processing which drops a dynamic range of the image data.

15. The image display apparatus according to claim 14, wherein in a case where the brightness of the image data is lower than a reference value, the control unit controls the emission brightness to be a lower value as a decrease amount of the contrast caused by the image processing is greater.

16. The image display apparatus according to claim 14, wherein in a case where the brightness of the image data is a reference value or higher, the control unit controls the emission brightness to be a higher value as a decrease amount of the contrast caused by the image processing is greater.

17. The image display apparatus according to claim 12, wherein the control unit includes:

a determining unit configured to determine a target value of the emission brightness according to the brightness information; and a correcting unit configured to correct the target value based on the brightness information and the change information, or based on the target value and the change information, so as to suppress the change in the contrast of the image, which is displayed on the screen, caused by the image processing.

18. The image display apparatus according to claim 12, wherein the control unit controls the emission brightness of the light-emitting unit based on the brightness information and the change information, so that the contrast of the image displayed on the screen is not changed by the image processing.

19. The image display apparatus according to claim 12, wherein the change information is based on a parameter relating to a red value R, a parameter relating to a green value G, and a parameter relating to blue value B.

20. The image display apparatus according to claim 12, wherein the image processing is processing to change a color of an image.

21. The image display apparatus according to claim 12, wherein the image processing is processing to change a color temperature of white to a target color temperature.

22. The image display apparatus according to claim 12, wherein the image processing is processing to change a color gamut of an image to a target color gamut.

23. A control method of an image display apparatus that includes a light-emitting unit, and a display unit configured to display an image on a screen by modulating light from the light-emitting unit based on image data, the control method comprising:

acquiring brightness information on brightness of the image data;

performing image processing on input image data;

acquiring parameters used for the image processing; and controlling emission brightness of the light-emitting unit based on the brightness information and the parameters, so as to suppress a change in contrast of an image, which is displayed on the screen, caused by the image processing.

24. A control method of an image display apparatus that includes a light-emitting unit, and a display unit configured to display an image on a screen by modulating light from the light-emitting unit based on image data, the control method comprising:

acquiring brightness information on brightness of the image data;

performing image processing on input image data;

acquiring change information, which is information on a change amount of contrast of an image, which is displayed on the screen, caused by the image processing; and controlling emission brightness of the light-emitting unit based on the brightness information and the change information, so as to suppress a change in the contrast caused by the image processing.

25. An image display apparatus, comprising:

a display unit configured to display an image on a screen by light emitted from light sources with emission brightness based on image data;

a first acquiring unit configured to acquire brightness information on brightness of the image data;

an image processing unit configured to perform image processing on input image data;

a second acquiring unit configured to acquire parameters used for the image processing; and a control unit configured to control the emission brightness of the light sources based on the brightness information and the parameters, so as to suppress a change in contrast of an image, which is displayed on the screen, caused by the image processing.

26. An image display apparatus, comprising:

a display unit configured to display an image on a screen by light emitted from light sources with emission brightness based on image data;

a first acquiring unit configured to acquire brightness information on brightness of the image data;

an image-processing unit configured to perform image processing on input image data;

a second acquiring unit configured to acquire change information, which is information on a change amount of contrast of an image, which is displayed on the screen, caused by the image processing; and a control unit configured to control emission brightness of the light sources based on the brightness information and the change information, so as to suppress a change in the contrast caused by the image processing.

* * * * *